US006506058B1

(12) United States Patent
Frances

(10) Patent No.: US 6,506,058 B1
(45) Date of Patent: Jan. 14, 2003

(54) WRITING BOARD WITH REFERENCE LINES WHICH ARE INVISIBLE FROM A DISTANCE AND FABRICATION PROCESS

(76) Inventor: Genaro Aldrete Frances, Lerdo de tejada 2189, Sector Juárez, Guadalajara, Jalisco 44150 (MX)

( * ) Notice: Subject to any disclaimer, the term of this patent is extended or adjusted under 35 U.S.C. 154(b) by 0 days.

(21) Appl. No.: 09/744,207

(22) PCT Filed: Jul. 21, 1999

(86) PCT No.: PCT/MX99/00022

§ 371 (c)(1),
(2), (4) Date: Mar. 29, 2001

(87) PCT Pub. No.: WO00/05081

PCT Pub. Date: Feb. 3, 2000

(30) Foreign Application Priority Data

Jul. 21, 1998 (MX) ..... 985916

(51) Int. Cl.[7] ..... B43L 1/00
(52) U.S. Cl. ..... 434/408; 434/416
(58) Field of Search ..... 434/408, 411, 434/412, 416, 421, 426, 428, 430; 428/68, 76; 40/615

(56) References Cited

U.S. PATENT DOCUMENTS

| | | | | |
|---|---|---|---|---|
| 2,541,497 A | | 2/1951 | Buxbaum et al. | |
| 3,486,246 A | | 12/1969 | Johnson, Jr. | |
| 3,574,956 A | | 4/1971 | Hamelin | |
| 4,605,246 A | * | 8/1986 | Haas | 282/29 |
| 4,996,110 A | * | 2/1991 | Tanuma | 428/343 |
| 5,163,846 A | * | 11/1992 | Lee | 434/408 |
| 5,200,853 A | | 4/1993 | Berkman | |
| 5,422,155 A | | 6/1995 | Spence, Jr. | |
| 5,431,450 A | * | 7/1995 | Coleman | 283/62 |
| 5,727,952 A | * | 3/1998 | Schenk | 434/408 |
| 5,791,910 A | * | 8/1998 | Masson | 434/410 |
| 5,827,072 A | * | 10/1998 | Neufer | 434/416 |

FOREIGN PATENT DOCUMENTS

| | | |
|---|---|---|
| FR | 677 091 | 3/1930 |
| FR | 833 157 | 10/1938 |
| FR | 1 312 780 | 11/1962 |
| FR | 2 304 484 | 3/1976 |
| FR | 2 617 093 | 12/1988 |

OTHER PUBLICATIONS

Patent Abstracts of Japan, Publication No. 07329489, Publication Date Dec. 19, 1995, "Ruling Method for Writing Board", Kato.

* cited by examiner

*Primary Examiner*—Derris H. Banks
*Assistant Examiner*—Kurt Fernstrom
(74) *Attorney, Agent, or Firm*—Browdy and Neimark, P.L.L.C.

(57) ABSTRACT

The present invention relates to a writing board with reference lines which are invisible from a distance, and to a process for its fabrication. The board is comprised of at least one support substrate (110) and one writing substrate (120) which are interconnected, wherein the reference lines (130) are so printed that they remain inserted between the support substrate and the writing substrate thereby increasing their durability. The reference lines (130) can be clearly seen by a person which is close to the writing board, while they are invisible for a person standing far from the board.

5 Claims, 1 Drawing Sheet

FIGURE 1
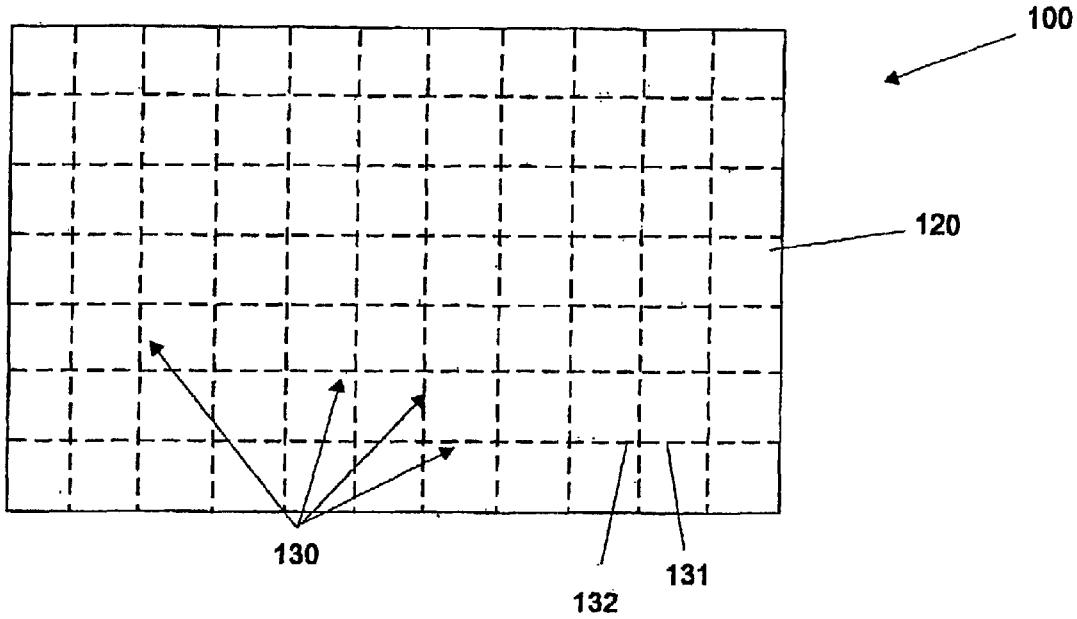
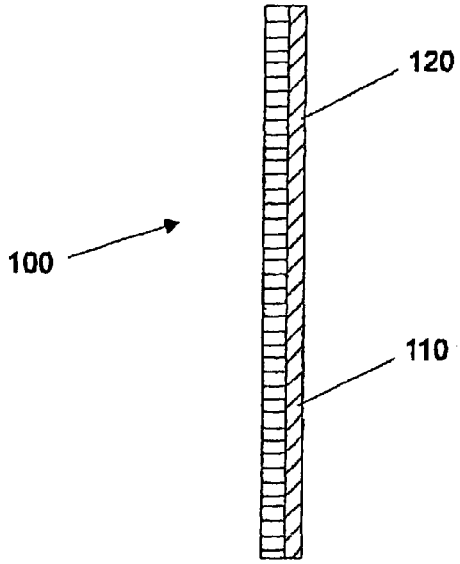
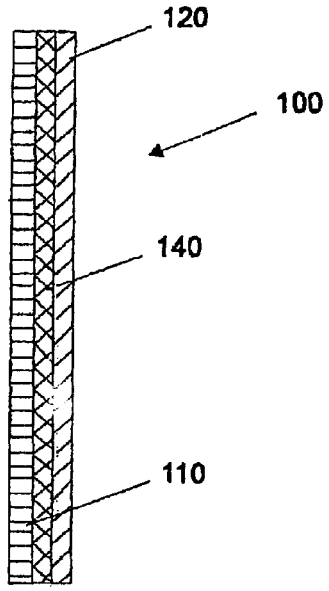
FIGURE 2 FIGURE 3

WRITING BOARD WITH REFERENCE LINES WHICH ARE INVISIBLE FROM A DISTANCE AND FABRICATION PROCESS

FIELD OF THE INVENTION

The present invention is related to the techniques for the production of writing boards, and more particularly, it is related to a writing board having reference lines invisible at a distance and with a process for producing the same.

BACK OF THE INVENTION

As it is widely known, writing boards have been used since a long time ago as instruments useful for writing information to be seen by an audience during the exposition of a theme. Such writing boards have the finality of allowing the information written therein to be easily erased, so as to permit the writing of further information on the same board. The most common writing boards are the so-called blackboards, which are employed in schools, auditoriums, meeting rooms and offices, in general.

The oldest writing boards are generally manufactured in dark colors, typically black or green. In order to print information on these boards, it is used a writing instrument made of porous materials that disintegrates when scratching the surface of the writing board, which traps the untied particles of the writing instrument on its surface. Obviously, the surface of these kind of writing boards must be rough enough to retain the untied particles as it permits their removal in case it is wanted to erase what it was originally printed.

Additionally, recently there have been developed white writing boards onto which information is printed by means of different writing instruments that contain easily removable inks. These kind of writing boards have smooth surfaces since precisely this property prevents ink from being trapped on their surfaces, thus allowing an easy removal of the ink.

One of the most frequent problems faced by persons who use writing boards is the difficulty of obtaining perfectly horizontal lines when the printing board has no reference lines. Similarly, there is a large amount of situations during expositions where the person who is using the writing board needs to draw figures, graphics or tables. This becomes a very hard situation when the writing board has no reference lines.

This problem has been solved a long time ago by means of the use of writing boards that include reference lines on their writing surface. Due to obvious reason, the reference lines should not be removed when the information on the writing board is erased. This is the reason why the known writing boards contain reference lines either engraved or stuck somehow.

The writing boards that include reference lines on their surface may include, rows, squares or any pattern suitable for the purpose of the writing board. Nevertheless, the reference lines of prior art writing boards can be seen at any distance or angle, causing said lines to be confused with the printed information. Furthermore, the reference lines cause the formation of relieves and/or fissures on the writing boards due to the nature of the engraves or stickers of the reference lines. Consequently, most of the times the device employed to write and/or draw on the writing board does not slip correctly. Additionally, the relieves and/or fissures cause the inks or substances used for writing with said tools to be trapped, thus making the information written and/or draw difficult to erase, problem which increases when different colors are used.

Another inconvenience of writing boards with reference lines is that cleaning and erasing the writing board, as well as the sole use of the writing board, cause the erosion or deterioration of the reference lines along time. Thus, it is necessary to mark them up or change them when required, in other words, it is necessary to give them frequent maintenance unlike the writing boards without reference lines, which need less frequent maintenance.

Nowadays, writing boards that include reference lines on their writing surface are manufacture, in a first stage, totally clean, with no references or engraves on their surface. Subsequently, they are subjected to an engraving process to form the lines or to a process where the reference lines are form with adhesive tapes or the like.

Consequently, for long it has been sought to overcome the inconveniences of prior art writing boards having reference lines by developing a writing board having reference lines which are invisible at a distance which allows a useful life for such lines longer than the useful life of the surface of the writing board, as it allows such reference lines to be seen only by the person who prints the information on the writing board, avoiding that the spectators confuse the reference lines with the information printed.

OBJECTIVES OF THE INVENTION

Having in mind the defects of the prior art, it is an object of the present invention to provide a writing board having reference invisible at a distance, which allows the reference lines to be seen only by the person who uses the writing board.

Another object of the present invention is to provide a writing board having reference lines invisible at a distance which reference lines have a useful life longer than the useful life of the surface of a prior art writing board.

One other aspect of the present invention is to provide a writing board having reference lines invisible at a distance having no relieves as the reference lines are formed, avoiding that such relieves make difficult the print of information on its surface.

An additional objective of the present invention is to provide a process for producing writing boards having reference lines invisible at a distance which allows the obtainment of such writing boards in an easy, practical and economical way.

BRIEF DESCRIPTION OF THE DRAWINGS

The novel features that are considered characteristic of the present invention are set forth with particularity in the appended claims. The invention itself, however, together with other objects and advantages thereof, will be best understood in the following detailed description of certain embodiments, when read in connection with the accompanying drawings, in which:

FIG. 1 is a front view of a writing board having reference lines invisible at a distance, built according to the principles of the present invention.

FIG. 2 is a cross section view of the writing board of FIG. 1.

FIG. 3 is a cross section view of a second embodiment of the writing board of FIG. 1.

DETAILED DESCRIPTION OF THE INVENTION

Having now more particular reference to the drawings, and more specifically to FIGS. 1 and 2 thereof, there is shown a preferred embodiment of the writing board 100 having invisible at a distance reference lines of the present invention. It comprises at least one supporting substratum 110 and at least one writing substratum 120 joined together, one of which includes printed and/or engraved invisible at a distance reference lines 130 on its internal surface, in such a way that the lines are trapped between the supporting substratum and the writing substratum and can be clearly noticed by a person away from the writing board approximately 0.5 meters, at the time the lines are not visible by a person away from the writing board a distance of more than 2.5 meters approximately. Within 0.5 meters and 2.5 meters, the lines can be noticed or not, in accordance to the visual capability of the watcher and the knowledge that such watcher concerning the existence of the reference lines. It is worth mentioning that the writing substratum 120 is transparent in this specific embodiment, in order to allow the invisible at a distance reference lines 130 to be visible for the person who writes.

In one preferred embodiment of the present invention, the supporting substratum is manufactured from at least one sheet of a material selected among wood, coal briquette, steel, glass, paper, board, plastics or combinations thereof; the writing substratum is made of a transparent material and includes at least one plate, cover, sheet or film obtained from polymeric resins, translucent paper, glass, paint, varnish, mica or combinations thereof; and, the lines are printed with an epoxy diluted ink.

In the preferred embodiment of the writing board 100 shown in FIG. 1, the reference lines are discontinuous and do not cross over each other. This improves the characteristic of invisibility of lines at a distance because it avoids the formation of nodes cause by the intersections of the lines. Furthermore, in order to improve results, the reference lines have a width of less than 1 millimeter.

The discontinuity of the liens is preferably established in such a way that the free length 131 of the discontinuous reference lines is approximately 20% larger than the printed length 132 of the same.

In FIG. 3, there is a second embodiment of the writing board 100, where there is a back substratum 140 placed between the supporting substratum 110 and the writing substratum 120. Such back substratum has reference lines printed on its surface, which is in touch with the writing substratum 120. The back substratum is preferably selected among paper sheets, pasteboard sheets, paint films, lac films or films of pastes of varied materials.

As it may be observed, the writing board 100 of the present invention can have an infinity of configurations. However, the optical property of the reference lines that allows them to be seen by the person who writes at the time they are not visible at a distance, depends on the intensity and the color of the ink, the color of the different substrata and the separation between lines.

Furthermore, the writing board 100 can be manufactured by prior art processes for producing writing boards without reference lines, by including an additional operation of line printing in accordance with the configuration desired for the board.

Nevertheless, in order to achieve the configuration of the specific embodiment of the writing board 100 of FIG. 3, it has been developed a process comprising a first printing stage where the reference lines with a specific pattern are printed on the surface of the back substratum 110. The back substratum 110 employed for printing is preferably design paper, in which are the reference lines 140 are printed with a roller for rotary press from an epoxy ink with a dilution from 10 to 30%.

Once the impression is finished, the back substratum is submitted to an assembling stage, in which the back substratum 140 is incorporated to the supporting substratum in order to finally place the writing substratum 120 onto the printed surface of the back substratum 140. In a preferred embodiment, the assembly is made by the adhesion of the back substratum on its non printed surface with the supporting substratum, in order to finally perform the distribution of a plastic resin of the melamine kind all over the printed surface of the back substratum 140.

Once the substrata are assembled, they are submitted to a curing stage, where the formed assembly is submitted to a temperature of 140° C. and a pressure greater than the atmospheric for 10 to 20 minutes approximately, in order to allow the resin to solidify, forming the writing substratum.

In one additional embodiment of the process of the present invention, before the curing stage, a texture is given to the external surface of the resin, according to the requirements of the final use of the writing board, preferably a rough texture.

The embodiment of the board in FIG. 3 allows to obtain a wide variety of colors in accordance to the back substratum 140 used, obviously searching for an ink color that may avoid drastic contrasts.

However, it has been found that when the back substratum 110 is white, the color that allows the obtainment of the optimal optic properties is the so-called optic green.

Similarly, it has been found that when a green color back substratum 140 of the type generally used in schools is used, the color that allows obtaining the optimal optic properties is dark green. Since the green back substratum 140 is preferably used for writing boards on which a chalk is used to write, in this embodiment the transparent writing substratum 120 has a rough surface.

It is important to emphasize that the reference lines of the writing board obtained by the process described before do not shed when applying the resin, neither during the curing, which is due to the combination of operations and materials used to manufacture the writing board 100.

The following examples are destined to illustrate the scope of the present invention in all its aspects, but they do not restrict it.

EXAMPLES

Process 1

One first writing board was produced according to the following: a pattern of discontinuous lines was printed in design paper by using a roller for rotary press from an ink for press and silk screen printing. Once dry, it was stuck by its non-printed surface to a coal briquette sheet and a plastic melamine type resin was placed all over the printed surface of the design paper. The assembly of coal briquette, printed paper and resin was submitted to a temperature of 140° C. at a pressure of 500 kg/cm$^2$ for 15 minutes, after which the resin was solid, thus forming the writing substratum. The reference lines were neat before the resin curing. However, once the curing was made, the ink of the lines was absorbed by the resin, obtaining dispersed, shade and blurred lines and the objective was not accomplished.

Process 2

A second writing board was manufactured according to the following: a discontinuous line pattern was printed on a design paper, using a roller for rotary press with an epoxy ink diluted 20%. Once it was dry, the design paper was stuck by its non-printed surface with a coal briquette sheet and a plastic melamine type resin was placed all over the printed surface of the design paper. The assembled piece of coal briquette, printed design paper and resin was submitted to a temperature of 140° C. at a pressure of 1 ton/cm$^2$ for its solidification to form the writing substratum. The reference lines were neat before and after the resin curing.

As it may be observed, the process for the second writing board, despite it has a few differences compared with the process used to obtain the first writing board, it allows to obtain reference lines trapped between the design paper and the melamine type resin for the lines to be seen neatly.

Following, it is shown a comparative table of the properties of different white writing boards with reference lines of less than a millimeter width, manufactured by process 2:

| WRITING BOARD | LINES COLOR | LINES PATTERN | % R | MAXIMUM NEAT PERCEPTION (METERS) | MAXIMUM PERCEPTION (METERS) |
|---|---|---|---|---|---|
| T1 | BLACK | C/CL | — | 10 | 25 |
| T2 | BLACK | D/NC | 20% | 5 | 15 |
| T3 | YELLOW | C/CL | — | 5 | 15 |
| T4 | BROWN | D/NC | 20% | 7 | 20 |
| T5 | OPTIC GREEN | C/CL | — | 1 | 5 |
| T6 | OPTIC GREEN | D/CL | 0% | 0.8 | 4 |
| T7 | OPTIC GREEN | D/NC | 0% | 0.7 | 3.5 |
| T8 | OPTIC GREEN | D/NC | 20% | 0.5 | 2 |
| T9 | OPTIC GREEN | D/NC | −16% | 0.5 | 2.5 |

Where:
D = Discontinuous lines
C = Continuous lines
CL = With crossed lines
NC = Without crossed lines $$\% R = \frac{\text{Free length of D}}{\text{Printed length of D}} \times 100 - 100$$

As it can be observed in the later examples, the combination between color and lines patterns is a fundamental point to achieve the desired effect. Nevertheless, the discontinuous pattern effect of the lines is the only one that can be applied to every color, since the results obtained for color combination are valid for white writing boards only, and consequently, it is necessary to use the adequate ink color for each writing board color.

In accordance to what it has been described, it may be observed that the writing board having reference lines invisible at a distance of the present invention has been designed so as to allow the person who prints the information on the surface to be able to note the lines clearly, while the spectators, who are further, can not see them. Furthermore, it will be evident for any skilled in the art that the embodiments of the writing board described herein before and illustrated in the attached drawings are only illustrative and non restrictive of the present invention, as there are many possible changes concerning its details without stepping apart from the invention's scope.

Although certain specific embodiments of the present invention has been illustrated and described above, it is to be understood that many modifications thereof are possible, such as different methods of printing or engraving the reference lines, different materials and colors of the different substrata and inks, the printing and/or engraving of the reference lines on several surfaces of the substrata, including external surfaces, different designs of the reference lines and different distances at which the reference lines are not noticed. The present invention, therefore, is not be restricted except insofar as is necessitated by the prior art and by the spirit of the enclosed claims.

What is claimed is:

1. A process for the production of writing boards having reference lines, comprising printing stage, an assembling stage and a curing state, characterized in that the printing stage comprises printing onto the surface of a back substratum a plurality of reference lines having a width less than one millimeter with a determined pattern by means of a roller for rotary press with a diluted epoxi ink; the assembling stage comprises the incorporation of the back substratum onto a supporting substratum in order to subsequently form, by means of the distribution of a plastic melamine resin, a writing substratum all over the printed surface of the back substratum; and, the curing stage is done by submitting the assembly to a temperature of 140° C. and a pressure greater than the atmospheric to allow the resin to solidify, thus forming the writing substratum.

2. A process for the production of writing board having reference lines, according to claim 1, further characterized in that the epoxy ink is diluted from 10 to 30%.

3. A process for the production of writing board having reference lines, according to claim 1, further characterized in that before the curing stage, the external surface of the resin is submitted to a treatment to modify its texture.

4. A process for the production of writing board having reference lines, according to claim 3, further characterized in that the texture is rough.

5. A process for the production of writing board having reference lines, according to claim 4, further characterized in that the texture is smooth.

* * * * *